US005681497A

United States Patent [19]

Labod

[11] Patent Number: 5,681,497

[45] Date of Patent: Oct. 28, 1997

[54] ARRANGEMENT FOR CONNECTING A STOPPER ROD FOR A METALLURGICAL VESSEL WITH A LIFTING DEVICE, SUITABLE STOPPER ROD FOR THE ARRANGEMENT AND PROCESS FOR PRODUCING THE ARRANGEMENT

[76] Inventor: Burkhard Labod, Blinder Weg 14, D-46446 Emmerich, Germany

[21] Appl. No.: 535,186

[22] PCT Filed: Apr. 25, 1994

[86] PCT No.: PCT/DE94/00452

§ 371 Date: Oct. 26, 1995

§ 102(e) Date: Oct. 26, 1995

[87] PCT Pub. No.: WO94/25204

PCT Pub. Date: Nov. 10, 1994

[30] Foreign Application Priority Data

Apr. 26, 1993 [DE] Germany ..... 43 13 427.0

[51] Int. Cl.[6] ..... B22D 41/20

[52] U.S. Cl. ..... 222/590; 222/602

[58] Field of Search ..... 222/602, 597, 222/590; 266/236, 45, 271; 264/30

[56] References Cited

U.S. PATENT DOCUMENTS

| | | | |
|---|---|---|---|
| 2,005,311 | 6/1935 | Belding | 222/602 |
| 3,331,539 | 7/1967 | Cofer et al. | 222/602 |
| 3,632,026 | 1/1972 | Thornton | 222/602 |
| 3,848,781 | 11/1974 | Springer | 222/602 |
| 4,271,994 | 6/1981 | Seaton | 222/602 |
| 4,946,083 | 8/1990 | Fishler et al. | 222/602 |
| 5,303,905 | 4/1994 | Pohl et al. | 222/602 |

FOREIGN PATENT DOCUMENTS

| | | |
|---|---|---|
| 0358535 | 3/1990 | European Pat. Off. . |
| 1240632 | 5/1969 | Germany . |
| 4040189 | 1/1992 | Germany . |
| 1004740 | 9/1965 | United Kingdom . |
| 1144424 | 5/1969 | United Kingdom . |

OTHER PUBLICATIONS

Mayer, Karl, Ernst; *What a Siemens–Martin Steelworker Has to Know at his Work*, Stahleisen Dec. 1963, pp. 152–155.

Int'l Search Report, dated Aug. 8, 1994.

Int'l Preliminary Exam Report, dated Jul. 18, 1995.

English Translation of Int'l Prelimanary Exam Report dated Jul. 18, 1995.

*Primary Examiner*—Scott Kastler

*Attorney, Agent, or Firm*—Vickers, Daniels & Young

[57] ABSTRACT

The arrangement (100) has a retaining rod (10) that is divided into an upper part (18) that is capable of being attached to a lifting device and a lower part (1) that projects into a plugging rod (2), that comprises a rapid connection device for the firm gas-tight connection of the lower part (1) to the upper part (18) whereby this permits easy exchange of a worn plugging rod. The region of the lower part (1) of the retaining rod (10) that projects into the plugging rod (2) is provided with means for engagement (3, 4, 35) that, as a result of communal isostatic compression engage with the ceramic material of the plugging rod (2) and generate a gas-tight, non-detachable connection of the lower part (1) of the retaining rod (10) to the plugging rod (2).

23 Claims, 2 Drawing Sheets

ARRANGEMENT FOR CONNECTING A STOPPER ROD FOR A METALLURGICAL VESSEL WITH A LIFTING DEVICE, SUITABLE STOPPER ROD FOR THE ARRANGEMENT AND PROCESS FOR PRODUCING THE ARRANGEMENT

BACKGROUND OF THE INVENTION

The use of fire-resistant plugging rods for regulating the flow of a metallic melt from a ladle or a tundish into an ingot mold has been known for a long time. For this purpose, the plugging rod is moved by a lifting device, that is adjacent to the outside of the tundish, in the direction of its longitudinal axis, as a result of which a pour-out opening, that is arranged at the bottom of the tundish, is opened to a greater or lesser extent whereby, in the lowered state, the plugging rod becomes engaged and flows completely into the pour-out opening. The flow of metallic melt is capable of being controlled as a result of this. Although such regulation is, in principle, very simple, special requirements are nevertheless set for the materials and the technical construction of the plugging rods in regard to the extreme conditions that prevail during the processing of steel. Thus the plugging rod must withstand the action of a metallic melt over several hours. In addition, the plugging rod must also be suitable for withstanding the intense temperature variations, that act on the plugging rod during a casting process, and to withstand the laterally acting forces that are produced by the buoyancy of the metallic melt and that exert a strong bending moment on the plugging rod. Breakage of the plugging rod inevitably leads to the situation where pouring out can no longer be shut off and this leads, as a consequence, to uncontrolled flowing out of the melt. It therefore represents a considerable safety risk.

In the case of an earlier known form of embodiment, the plugging rod consists of a steel rod that has been provided with a screw thread at one end onto which the actual ceramic plug is screwed that engages in the pour-out opening of the tundish during later use. Above the plug, several ceramic plugging tubes that engage with one another at their front surfaces via a groove and spring and that completely encase the steel rod are pushed on from the side of the steel rod that is opposite the plug in such a way that, in the case of a tundish that is filled with a steel melt and a completely lowered plugging rod, the part of the plugging rod that is jacketed by the plugging tubes projects out of the melt by a certain length. The plugging rod is mounted in the lifting device via the upper end of the steel rod. Since direct contact of the melt with the steel rod would lead to the immediate melting through thereof, special attention has to be paid with such a plugging rod, that is made from several parts (plugs, plugging tubes), to the feature that the connections between the individual parts are leakproof in terms of the penetration of the steel melt. The connection locations are therefore additionally cemented. The plugging rods that are prepared are dried in a drying oven at approximately 100° C. for approximately two days prior to their use.

A disadvantageous feature in the case of this earlier form of embodiment is that the preparation of the plugging rods requires relatively high expenditure on site in terms of material and labor. The steel rods also tend to distort as a result of the temperature gradients and variations that arise during casting and this easily leads to breakage of the jacketing and can thus lead to destruction of the plugging rod. These disadvantages and the knowledge that, as a result of the introduction of inert gases—such as, for example, argon—into the steel melt, non-metallic contaminants are, on the one hand, transported to the bath surface of the melt as a result of their interaction with the gas bubbles and, on the other hand, the formation of oxide during the casting process is reduced, have led to the development of ceramic plugging rods that are manufactured in one piece, as a result of which the inert gas is capable of being introduced simultaneously into the steel melt. These one-piece plugging rods, that are used almost exclusively in the manufacture of steel today, have a central longitudinal hole, that does not break through its lower end, and connecting holes that communicate with the longitudinal hole from the outside and that serve for the introduction of the inert gas into the steel melt.

The manufacture of such plugging rods usually takes place by isostatic compression of ceramic material that is present in a powder-like form to give a blank that is subsequently calcined, i.e. subjected to high temperature treatment for the purpose of sintering.

A one-piece retaining rod, that is usually made of steel, serves for connecting the plugging rod to the lifting device and for the connection to a gas feed line, whereby the retaining rod projects into the plugging rod from the top and over a certain region and is firmly connected thereto. A gas channel is incorporated into the retaining rod and communicates, on the one hand, with the longitudinal hole of the plugging rod and, on the other hand, it communicates with a connection device for the gas feed line. In this regard, it is of particular significance that, as a result of the connection between the retaining rod and the plugging rod, no air from the surroundings gets into the interior of the plugging rod and thus into the steel melt since this would lead to increased oxidation and hence worsening of the quality of the steel.

The technical implementation of the connection between the ceramic plugging rod and the metallic retaining rod is problematical, particularly because of the high thermal and mechanical stresses that act on the connection.

Various devices for the preparation of the connection between a one-piece plugging rod and a retaining rod that allegedly meet one's expectations in regard to the importance of the plugging rod in terms of safety and the quality of the steel are already known.

In a first known device, the connection is prepared by means of a ceramic screw thread insert, that has been adapted to the retaining rod, whereby the insert is capable of being screwed from above into the plugging rod via a screw thread that has been pressed into the upper region of the plugging rod. A disadvantageous feature in the case of this device is that the thickness of the wall of the plugging rod is markedly reduced in the region of the screw thread that is used; as a result of this, it easily breaks in this region. Because of the use of screw thread inserts that have to be prepared separately, this device is also relatively expensive in terms of manufacture.

In the case of a second known device, a transverse hole, that passes through both parts, is incorporated into the region in which the retaining rod is inserted into the plugging rod whereby a peg is pushed into the transverse hole in order to hold the plugging rod. Although the plugging rod and the retaining rod are both simple in terms of manufacture and they can be separated with ease in the case of this device, the total load, that arises during the lifting of the plugging rod, nevertheless acts on the material that surrounds the transverse hole as a result of which material fractures occur frequently once more. In addition, the preparation of a gas-tight connection is rendered difficult.

In the case of a third known device, a threaded hole is incorporated—by means of isostatic compression—into the upper end of the plugging rod whereby the retaining rod is screwed directly into the plugging rod via the screw thread that is provided at its lower end. Although a gas-tight connection is, in principle, possible between the plug and the retaining rod in this device, the differing thermal coefficients of expansion of ceramic material and steel nevertheless lead to the formation of stresses in the screw thread and this can lead to breakage of the plugging rod especially at elevated temperatures.

A device in accordance with EP 0 358 535 A 2 represents a further development of the designated forms of embodiment. In the case of this device, a metallic screw-threaded bush is compressed isostatically in the upper region of the longitudinal hole, whereby the bush is externally engaged with the plugging rod material via alternately arranged peripheral grooves and peripheral ridges. Above the threaded bush, an annular sealing surface is formed in the plugging rod by increasing the diameter of the longitudinal hole. The retaining rod, that has been provided with a corresponding screw thread, is capable of being screwed into the screw-threaded bush sufficiently far from above until a sealing joint, that is arranged above the screw thread, is supported at the sealing surface of the annular sealing seat. In accordance with EP 0 358 535 A 2, an external screw thread is provided at the retaining rod above the sealing joint in order to counteract the plug by means of a retaining plate and a nut that is screwed thereon. A disadvantageous aspect in the case of this form of embodiment is that the metallic screw-threaded bush can readily become scaly during calcination, as a result of which the screwing in of the retaining rod can become difficult. In addition, the process of tightening—that counteracts the compressive pressure on the sealing joint of the retaining rod on the annular sealing surface of the plugging rod—of the counter nut as a result of the differing coefficients of thermal expansion can lead to lifting of the two sealing surfaces from one another, especially at elevated temperatures. This device is also relatively expensive in terms of its manufacture. Thus, in particular, the sealing joint that is provided at the retaining rod and the screw thread that is necessary for the screwing on of the counter nut require the manufacture, under tension, of the retaining rod from a blank that has at least the external diameter of the sealing joint. The loss of material that can be recorded during fabrication is, as a result, of the order of 50%. Thus, the loss of material represents a considerable cost factor, especially since the life of the retaining rod is relatively short—particularly as a result of the rapid formation of scales in the region that is exposed to the most intense action of temperature.

SUMMARY OF THE INVENTION

The task that forms the basis of the invention is to further develop an arrangement in accordance with this type of device such that it is simpler and more favorable in terms of price during manufacture and that it is also more economical in use and that a worn plugging rod can be exchanged for a new one on location by the personnel with few manipulative actions.

An arrangement for connecting an extended plugging rod used to plug a metallurgical vessel, to the lifting device for the plugging rod with a retaining rod is provided. The retaining rod is divided into a lower part, a portion projecting into the plugging rod, and an upper part capable of being attached to the lifting device. A rapid connection device is provided at a segmentation site between the lower and upper parts of the retaining rod which is capable of connecting the two parts together in a gas-tight manner.

Worn plugging rods together with the lower part of the retaining rod can be exchanged with ease via the division of the retaining rod into a lower part that projects into the plugging rod and an upper part that is capable of being attached to a lifting mechanism and the use of a rapid connection device with which the two parts of the retaining rod are capable of being connected firmly to one another in a gas-tight manner. Although, in the arrangement in accordance with the invention, the lower part of the plugging rod is provided for use on only one occasion, material can be saved in comparison to earlier forms of embodiment. Since the lower part of the retaining rod is exposed to high thermal stresses in particular, this becomes scaly even after a short period of use. Whereas—after a particular degree of scaling has been attained in the lower region of the retaining rod—the entire retaining rod had to be exchanged for a new one in the case of earlier forms of embodiment, the upper part, that is more expensive to manufacture, remains usable for considerably longer as a result of the division of the retaining rod.

The retaining rod can be produced in a manner that is especially favorable in terms of cost if it is manufactured from a metallic material.

Since the part of the retaining rod that is connected to the plugging rod is provided for use on only one occasion, this is manufactured from a low alloy steel in the preferred form.

The life of the upper part of the retaining rod can be extended considerably if it is manufactured from stainless steel.

A preferred form of embodiment of the rapid connection device is formed by arranging a conical sealing surface at the lower front side of the upper part of the retaining rod, whereby a screw cap extends beyond the sealing surface on a flange that forms a peripheral projection whereby the screw cap is capable of being brought into engagement via a screw thread that extends from the upper end of the lower part of the retaining rod, over a certain length, and whereby the lower part of the retaining rod is capable of being pressed into the conical sealing surface by the screw cap via the upper front surface of the lower part of the retaining rod that forms the counter-sealing surface.

Especially good sealing action is achieved if the surface of the upper front side of the lower pan of the retaining rod that forms the counter-sealing surface has a curvature that is directed upward in such a way that the adjoining sealing surface of the upper front side of the lower part of the retaining rod and the lower front side of the upper part of the retaining rod have the form of a closed circular line.

A further form of embodiment, that is also preferred is one, in which the rapid connection device is constructed in the form of a plug connection that is capable of being connected by means of plug action in which a heat-resistant peripheral sealing washer finds use for sealing.

Glass fiber material that is inserted into a peripheral groove, a graphite washer that is capable of being opened up and that is capable of being inserted into a peripheral groove, or a metallic washer that rests in a peripheral groove are especially suitable for the construction of the peripheral sealing washer.

A configuration of the device for the firm accommodation of the retaining rod in the plugging rod is for the manufacture, that is favorable in terms of price, of a reliable connection of the two-part retaining rod to the plugging rod. However, in the case of conventional one-part retaining rods, it is also possible to provide, on their length that projects into the plugging rod, means of engagement for mutual engagement with the fire-resistant material of the plugging rod, whereby the means of engagement connect together the retaining especially secure, non-rotatable manner that is non-detachable.

An especially secure, non-rotatable seating of the retaining rod in the plugging rod and an extensively gas-tight connection is achieved if, the means of engagement consist of a number of sequential peripheral grooves and peripheral ridges that are formed at the lower end of the retaining rod as well as one or more keying surfaces that run approximately parallel to the longitudinal axis of the arrangement, whereby the keying surfaces are in engagement with the peripheral grooves and peripheral ridges in the upper part of the longitudinal recess of the plugging rod as well as with one or more flat projections and, as a result, a labyrinth-type seal is formed between the two parts, as a result of which the material-intensive formation of a sealing joint can be dispensed with.

Especially good sealing action can be produced in the connection if, at least one of the peripheral grooves of the lower part of the retaining rod carries a flexible, fire-resistant seal that operates in conjunction with a peripheral ridge on the plugging rod.

The already firm, essentially gas-tight, seating of the retaining rod in the plugging rod can be improved still further in the case of especially stringent requirements by way of the feature that the lower part of the retaining rod has an external screw thread that extends from the upper front side of the plugging rod upward over a certain length, whereby a nut is screwed onto the external thread from above whereby the nut is supported by means of a pressure washer that is provided between the nut and the upper front side of the plugging rod, so that the upper flanks of the peripheral grooves of the lower part of the retaining rod are pressed against the lower flanks of the peripheral ridges of the plugging rod.

In this way, the region between the lower end of the external screw thread and the upper peripheral ridge of the retaining rod can serve for the elastic accommodation of longitudinally directed stresses if, the separation between the lower end of the external screw thread and the upper peripheral ridge amounts to at least 1.4 times the external diameter of the non-profiled part of the retaining rod that projects into the plugging rod.

In a preferred embodiment, the plugging rod includes a number of peripheral grooves and peripheral ridges including one or more projections at the curve of the recess in the upper part of the longitudinal recess and symmetrically to the longitudinal axis whereby the grooves and ridges of the plugging rod are capable of being brought into engagement with the peripheral grooves and peripheral ridges of the retaining rod.

A process for the manufacture of a device in accordance with the present invention is also provided. In this connection, a secure, non-detachable and essentially leak-proof seating of the retaining rod in the plugging rod is achieved by way of the feature that the retaining rod is pressed into the plugging rod during the isostatic compression of the plugging rod in such a way that the means for engagement of the retaining rod are surrounded completely by the ceramic material that engages with it and that the plugging rod is calcined, together with the retaining rod, following isostatic compression.

In this way, excessive stresses—especially those that arise at high temperatures—between the retaining rod and the plugging rod can be avoided if, the part of the retaining rod that projects into the plugging rod is coated with a material prior to communal isostatic compression that evaporates during calcination.

It is especially advantageous for saving material, and thus economizing in terms of costs, if the screw thread and the peripheral grooves and peripheral ridges are incorporated into the retaining rod in a manner in which they are free from tension.

A form of embodiment of the invention is illustrated in the drawing.

DETAILED DESCRIPTION OF THE INVENTION

Figure 1:
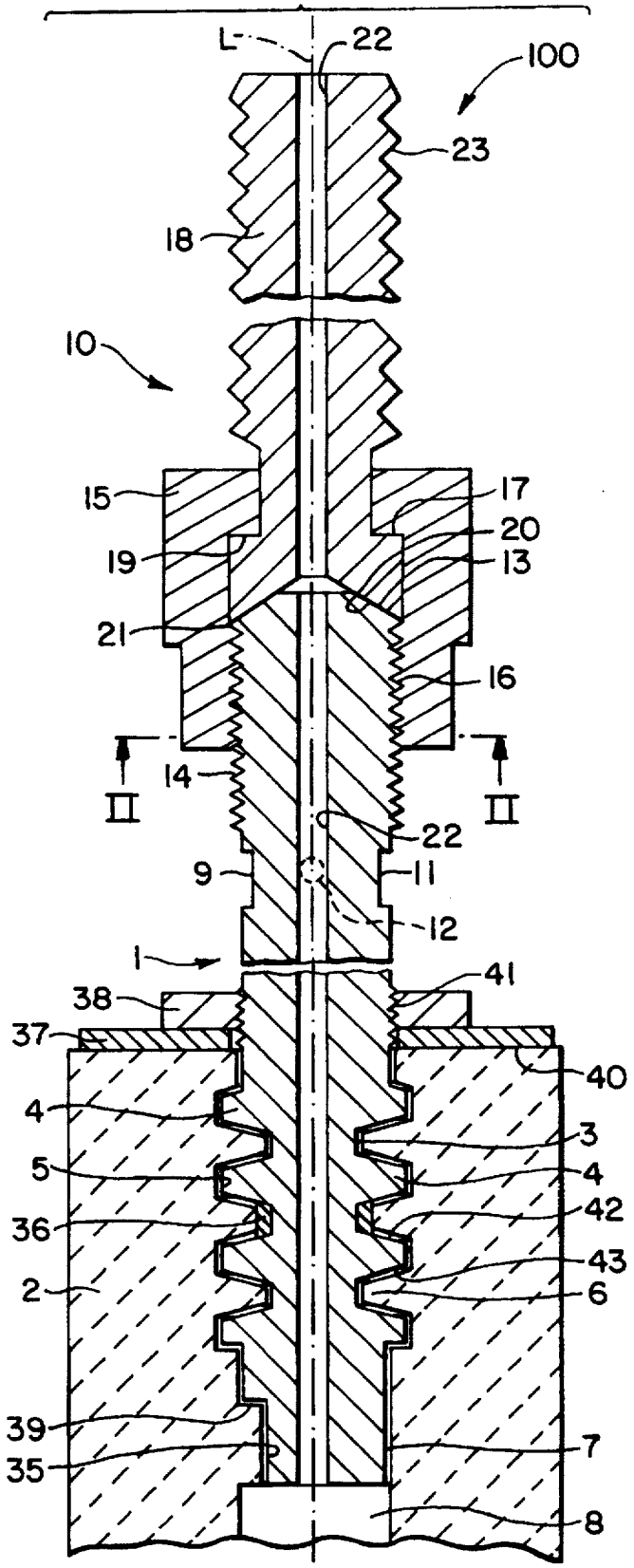
FIG. 1 shows a longitudinal section through a first form of embodiment of the device in accordance with the invention.

When "upper" or "lower" [translator: and the corresponding adverbs etc. deriving therefrom] are used in the following sections, these relate to the suspended operating arrangement of the device in FIGS. 1 and 3.

The arrangement in the drawing, that is designated in its entirety by 100, consists of a two-part metallic retaining rod 10,10' whose lower part 1,1' projects over a certain distance into the fire-resistant ceramic plugging rod 2. A number of sequential peripheral grooves 3,3' and peripheral ridges 4,4' and a keying surface 35 that runs parallel to the longitudinal axis L of the arrangement 100 are arranged in the region of the lower part 1,1' of the retaining rod 10,10' that projects into the plugging rod 2. As a result of communal isostatic compression, an arrangement comprising peripheral grooves 5 and peripheral ridges 6 and a projection 39 is produced in the plugging rod whereby the arrangement is engaged with the peripheral grooves 3,3' and the peripheral ridges 4,4' and the keying surface 35. In addition to a firm non-rotatable seating of the lower part 1,1' of the retaining rod 10,10' in the plugging rod 2, a labyrinth-type seal, that is essentially gas-tight, is produced as a result of such construction of the connection. The sealing action of the connection is further increased as a result of the feature that a flexible fire-resistant sealing washer 36 is inserted into one of the peripheral grooves 3,3' of the lower part 1,1' of the retaining rod 10,10' whereby the sealing washer operates in conjunction with a peripheral ridge 6 of the plugging rod 2. The lower part 1,1' of the retaining rod 10,10' comprises an external screw thread 41 that extends upward over a certain distance from the upper front side 40 of the plugging rod 2, whereby a nut 38,38' is screwed onto the front side 40 on the external screw thread from above whereby the nut exerts a bracing action by means of a pressure washer 37,37' that has been has been provided between the nut 38,38' and the upper front side 40 of the plugging rod 2 so that the upper flanks 43,43' of the peripheral ridges 4,4' of the lower part 1,1' of the retaining rod 10,10' are pressed against the lower flanks 42 of the peripheral ridges 6 of the plugging rod. The region between the lower end of the external screw thread 41 and the upper end of the peripheral ridges 4,4' of the lower part 1,1' of the retaining rod 10,10' whose length corresponds to at least 1.4 times its diameter serves for the elastic accommodation of the longitudinally directed stresses that arise, in particular, as a result of tightening the nut 38,38' and that change in thickness as a result of the action of a high temperature on the arrangement.

In order to prevent the generation of radially directed stresses—especially at higher temperatures—between the plugging rod 2 and the lower part 1,1' of the retaining rod 10,10', the region of the lower part 1,1' of the retaining rod 10,10' that projects into the plugging rod is coated with a material prior to pressing whereby the material evaporates during the subsequent calcination process that serves for sintering the ceramic material so that after calcination—especially at low temperatures—a certain gap 7 exists between the jacket surface of the lower part of the retaining rod and the internal wall of the plugging rod.

A longitudinal recess 8 continues in the plugging rod 2 below the lower part 1,1' of the retaining rod 10,10', whereby the recess serves for the supply of gas to the gas outlet channels that are arranged in the lower part of the plugging rod 2 though these are not shown in the drawing.

Figure 2:
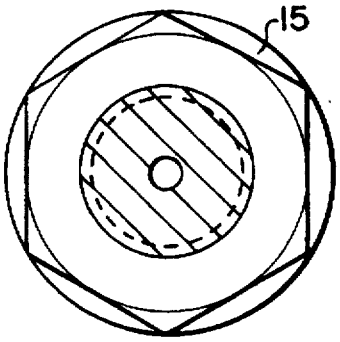
FIG. 2 shows a view in accordance with the line II—II in FIG. 1.

In the example of an embodiment in accordance with FIGS. 1 and 2, the lower part 1 of the retaining rod 10 that extends upward in the direction of the longitudinal axis L is provided above the plugging rod 2 with two parallel flat surfaces 9,11 or, respectively, with a circular depression 12 that serves for the engagement era wrench or, respectively, a hook wrench. An external screw thread 14 extends downward over a certain distance from the upper front side 13, that is constructed in the form of a conical ring-shaped sealing surface, of the lower part 1 of the retaining rod 10, whereby the external screw thread is capable of being brought into engagement with an internal screw thread 16 that is arranged in the screw cap 15.

The screw cap 15, that has a step-like reduction of its internal diameter in its upper region and hence a ring-shaped seating surface 17, is pushed onto the part 18 of the retaining rod 10 from above and is supported on a peripheral projection 19 that is arranged near the lower end of the upper part 18 of the retaining rod 10. The lower front side 20 of the upper part 18 of the retaining rod 10 forms the counter-sealing surface to the ring-shaped sealing surface 13 of the lower part 1 of the retaining rod 10 and has a curvature that is directed upward in such a way that the sealing seating surface of the upper front side 13 of the lower part 1 of the retaining rod 10 and the lower front side 20 of the upper part 18 of the retaining rod 10 has the shape of a closed circular line.

As a result of tightening the screw cap 15 against the lower part 1 of the retaining rod 10, the two parts 1,18 of the retaining rod 10 are capable of being connected firmly to one another in a mutually sealing manner so that, at the connection location 21, no gas can force its way through to the outside out of the gas channel 22 that extends through the entire retaining rod 10 along the longitudinal axis L. The upper part 18 of the retaining rod 10 is provided with an external screw thread 23 that serves for the attachment of the arrangement 100 to a lifting device that is arranged on the outside of the tundish and serves for lowering the arrangement.

Figure 3:
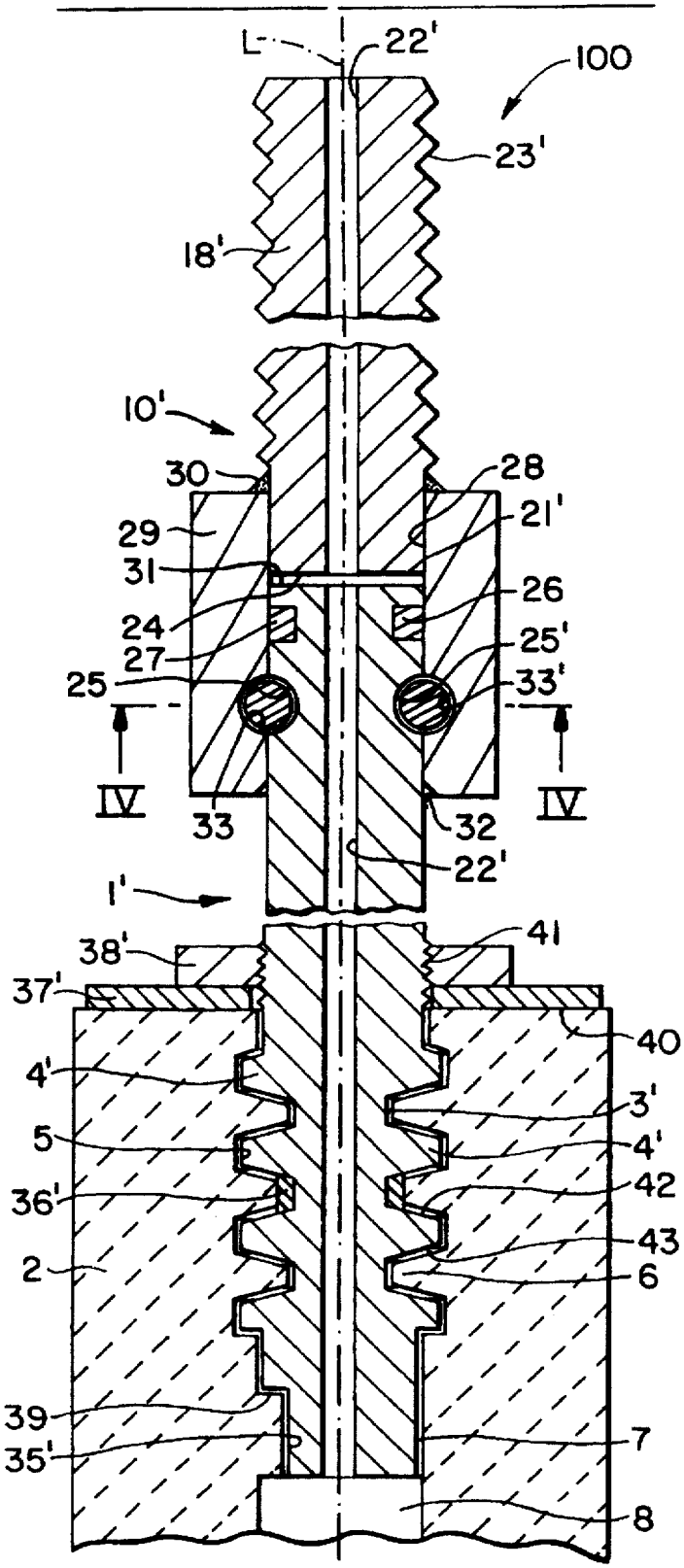
FIG. 3 shows a longitudinal section through a further form of embodiment of the device in accordance with the invention.
Figure 4:
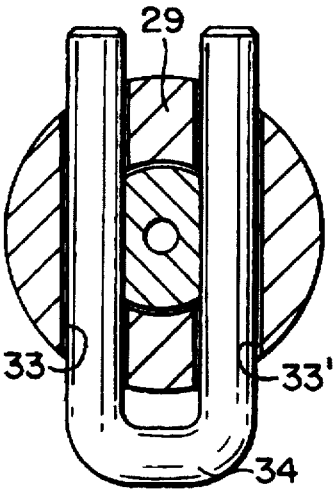
FIG. 4 shows a view of the arrangement in accordance with the line IV—IV in FIG. 3.

In the preferred example of an embodiment in accordance with FIGS. 3 and 4, two parallel, opposing recesses of semi-circular cross section that run vertically to the longitudinal axis L have been incorporated, at a certain distance relative to the front side 24, in the external periphery of the lower part 1' of the retaining rod 10'. Between the recesses 25,25' and the upper front side 24, a peripheral groove 26 has been provided in the lower part 10' whereby the peripheral groove serves for the accommodation of a sealing washer 27 that is made of temperature-resistant glass fiber material, graphite or metal.

Seen from its upper side, the upper part 18' of the retaining rod 10' forms a rod that has been provided, over a certain length, with an external screw thread 23' at which, from below, a sheath-like extension 29 is formed in one part or it is pushed onto a region that is not provided with a screw thread and is connected at its upper side, by means of a peripheral welded seam 30, to the upper part 18' of the retaining rod 10' [translator: the original is a little unclear here]. The part of the extension 29 that extends beyond the lower front side 31 is formed internally in such a way that the upper end of the lower part 1' of the retaining rod 10' is capable of being slid into the extension 29 and forming a sliding fit whereby this is facilitated by an internally arranged phase [sic] at the lower end of the extension. In its region that juts out over the front side 31, the extension 29 has two holes 33,33' that are parallel to one another and that have been arranged vertically to the longitudinal axis L whereby the separation of the holes relative to one another—based on the centers of the holes—corresponds precisely to the internal diameter of the extension 29 and they communicate with the recesses 25,25' in the inserted state of the lower part 1'.

In order to install the plugging rod 2 that has been equipped with the lower part 1' of the retaining rod 10', the lower part 1 is inserted into the sheath-like extension 29 of the upper part 18' of the retaining rod 10' and secured against slipping out by means of a U-shaped securing brace 34 with the open ends of its shanks being capable of insertion into the holes 33,33' and engaging in the recesses 25,25'. As a result, the exchange of a worn plugging rod is possible in a simple manner without the use of tools.

As a result of the configuration of the retaining rods 10, 10' in accordance with the invention and as a result of the feature that the screw threads 14,23,23' and the peripheral grooves 3,3' and the peripheral ridge 4,4' are formed via a tension-free mode of implementation, a considerable saving in material is achieved during the manufacture of the retaining rods.

Having thus described the invention it is claimed:

1. Arrangement for connecting an extended plugging rod comprising a fire-resistant material for a metallurgical vessel, to a lifting device for the plugging rod with a retaining rod, the retaining rod being engaged at a first end by the lifting device and at a second end projects into a front side of the plugging rod, the retaining rod firmly retained within the plugging rod, the improvement comprising the retaining rod being divided into two generally separate and parallel parts, said parts including a lower part that projects into the plugging rod and an upper part that is capable of being attached to .the lifting device, a rapid connection device being provided at a segmentation site where the lower part and upper part are connected, the two parts of the retaining rod being connected firmly to one another in a gas-tight manner.

2. Arrangement in accordance with claim 1, wherein the retaining rod is manufactured from a metallic material.

3. Arrangement in accordance with claim 2, wherein the lower part of the retaining rod is manufactured from a low alloy steel.

4. Arrangement in accordance with claim 3, wherein the upper part of the retaining rod is manufactured from stainless steel.

5. Arrangement for connecting an extended plugging rod comprising a fire-resistant material for a metallurgical vessel, to the lifting device for the plugging rod with a retaining rod, at one end of which the lifting device engages, and that projects, via its other end, from one front side of the plugging rod into the plugging rod over a certain distance and with a device for the firm accommodation of the retaining rod in the plugging rod, the improvement comprising the retaining rod being divided into a lower part that projects into the plugging rod and an upper part that is capable of being attached to the lifting device and that a rapid connection device is provided at the segmenentation site by which the two parts of the retaining rod are capable of being connected firmly to one another in a gas-tight manner, the upper part of the retaining rod having a lower front side, the lower front side of the retaining rod being constructed in the form of a conical sealing surface, over which a screw cap extends that is supported on a flange that forms a peripheral projection whereby the screw cap is capable of being brought into engagement with a screw thread that extends over a certain distance from an upper end of the lower part of the retaining rod having an upper front side and whereby the lower part of the retaining rod is capable of being pressed by the screw cap into the conical sealing surface via the upper front side that forms the counter-sealing surface.

6. Arrangement in accordance with claim 5, wherein the surface of the upper front side, that forms the counter-sealing surface, of the lower part of the retaining rod has a curvature that is directed upward in such a way that the sealing seating surface of the upper front side of the lower part of the retaining rod and the lower front side of the upper part of the retaining rod have the form of a closed circular line.

7. Arrangement for connecting an extended plugging rod comprising a fire-resistant material for a metallurgical vessel, to the lifting device for the plugging rod with a retaining rod, at one end of which the lifting device engages, and that projects, via its other end, from one front side of the plugging rod into the plugging rod over a certain distance and with a device for the firm accommodation of the retaining rod in the plugging rod, the improvement comprising the retaining rod being divided into a lower part that projects into the plugging rod and an upper part that is capable of being attached to the lifting device and that a rapid connection device is provided at the segmentation site by which the two parts of the retaining rod are capable of being connected firmly to one another in a gas-tight manner, wherein the upper part of the retaining rod includes a flat lower front side and at the lower end of the upper part of the retaining rod a sheath extension extends over the flat lower front side whereby the extension comprises, in its projecting region, two parallel transverse holes that are arranged vertically to the longitudinal axis of the retaining rod that, are spaced a certain distance from the lower front side in the longitudinal direction of the retaining rod and have a distance therebetween that corresponds—on the basis of the centers of the holes—to the retaining rod internal diameter, whereby the lower part of the retaining rod—that, near its upper end, carries a heat-resistant peripheral sealing washer with two recesses that are arranged vertically to the longitudinal axis and parallel to each other at its periphery that are provided with semicircular cross sections—is capable of being inserted in a manner that forms a sliding fit in the extension in such a way that, in the inserted state, the recesses corresponds to the transverse holes and a U-shaped securing brace is capable of being inserted via the open ends of its shanks into the holes in a manner where engagement takes place in the recesses.

8. Arrangement in accordance with claim 7, wherein the lower part includes a peripheral groove and the heat resistant peripheral sealing washer comprises a glass fiber material that has been inserted into the peripheral groove.

9. Arrangement in accordance with claim 7, wherein the lower part includes a peripheral groove and the heat-resistant peripheral sealing washer comprises a graphite washer, that is capable of being opened up and that has been inserted into the peripheral groove.

10. Arrangement in accordance with claim 7, wherein the lower part includes a peripheral groove and the heat-resistant peripheral sealing washer comprises a metal washer, that is capable of being opened up and that has been inserted into the peripheral groove.

11. Arrangement for connecting an extended plugging rod comprising a fire-resistant material for a metallurgical vessel, a lifting device for the plugging rod with a retaining rod, the retaining rod being engaged at a first end by the lifting device and at a second end having a lower part that projects into a front side of the plugging rod and a longitudinal recess extending therein from the front side and a device on the lower part for firmly retaining the retaining rod within the plugging rod, the improvement comprising the device for firmly retaining the retaining rod within the plugging rod comprising means for mutual engagement with the fire-resistant material of the plugging rod that connects the retaining rod and the plugging rod non-detachably with one another.

12. Arrangement in accordance with claim 11, wherein the means for engagement comprises a number of sequential peripheral grooves and peripheral ridges formed at the lower part of the retaining rod as well as one or more keying surfaces running approximately parallel to the longitudinal axis of the arrangement, whereby the keying surfaces are engaged with peripheral grooves and peripheral ridges as well as with one or more projections in the upper part of the longitudinal recess.

13. Arrangment for connecting an extended plugging rod comprising a fire-resistant material for a metallurgical vessel, to a lifting device for the plugging rod with a retaining rod, the retaining rod being engaged to a first end by the lifting device and at a second end having a lower part that projects into a front side of the plugging rod and a longitudinal recess extending therein from the front side and a device for the firm accommodation of the retaining rod in a plugging rod, the improvement comprising at the retaining rod and on its length that projects into the plugging rod the device for the firm accommodation of the retaining rod in the plugging rod comprises means for mutual engagement with the fire-resistant material of the plugging rod that connects the retaining rod and the plugging rod non-detachably with one another, the means for engagement comprising a number of sequential peripheral grooves and peripheral ridges formed at the lower part of the retaining rod as well as one or more keying surfaces naming approximately parallel to the longitudinal axis of the arrangement, whereby the keying surfaces are engaged with peripheral grooves and peripheral ridges as well as with one or more projections in the upper part of the longitudinal recess and at least one of the peripheral grooves of the lower part of the retaining rod carries a flexible fire-resistant sealing washer that operates in conjunction with the peripheral ridge of the plugging rod.

14. Arrangement in accordance with claim 12, said plugging rod including an upper front side, said peripheral ridges of said retaining rod including upper flanks and said peripheral ridges of said plugging rod including lower flanks, wherein the lower part of the retaining rod has an external screw thread that extends upward over a certain distance from the upper front side of the plugging rod whereby, from above, a nut is screwed onto the external screw thread whereby the nut is supported on the front side by a pressure washer that is provided between the nut and the upper front side of the plugging rod so that the upper flanks of the peripheral ridges of the lower part of the retaining rod are pressed against the lower flanks of the peripheral ridges of the plugging rod.

15. Arrangement for connecting an extended plugging rod comprising a fire-resistant material for a metallurgical vessel, to a lifting device for the plugging rod with a retaining rod, the retaining rod being engaged at a first end by the lifting device and at a second end, having a lower part that projects into a front side of the plugging rod and a longitudinal recess extending therein from the front side and a device for the firm accommodation of the retaining rod in a plugging rod, the improvement comprising at the retaining rod and on its length that projects into the plugging rod the device for the firm accommodation of the retaining rod in the plugging rod comprises means for mutual engagement with the fire-resistant material of the plugging rod that connects the retaining rod and the plugging rod non-detachably with one another, the means for engagement comprising a number of sequential peripheral grooves and peripheral ridges formed at the lower part of the retaining rod as well as one or more keying surfaces running approximately parallel to the longitudinal axis of the arrangement, whereby the keying surfaces are engaged with peripheral grooves and peripheral ridges as well as with one or more projections in the upper part of the longitudinal recess, the lower part of the retaining rod having an external screw thread that extends upward over a certain distance from the upper front side of the plugging rod whereby, from above, a nut is screwed onto the external screw thread whereby the nut is supported on the front side by a pressure washer that is provided between the nut and the upper front side of the plugging rod so that the upper flanks of the peripheral ridges of the lower part of the retaining rod are pressed against the lower flanks of the peripheral ridges of the plugging rod and the distance between the lower end of the external screw thread and the upper peripheral ridge amount to at least 1.4 times the external diameter of the non-profiled part of the retaining rod that projects into the plugging rod.

16. Arrangement in accordance with claim 11, the plugging rod including a longitudinal recess, wherein in the upper part of the longitudinal recess, the plugging rod comprises shaped means that are capable of being brought into operational connection with the means of engagement of the retaining rod.

17. Arrangement in accordance with claim 16, wherein the plugging rod comprises a number of peripheral grooves and peripheral ridges as well as one or more projections in the upper part of the longitudinal recess and symmetrical to the longitudinal axis whereby the projections are capable of being brought into engagement with the peripheral grooves and peripheral ridges and with at least one keying surface of the retaining rod.

18. Process for the manufacture of an arrangement for connecting an extended plugging rod comprising a fire-resistant material, for a metallurgical vessel, to a lifting device for the plugging rod with a retaining rod, and isostatically compressing the plugging rod, the retaining rod being pressed into the plugging rod in such a way that means for engagement of the retaining rod is completely surrounded by a ceramic material that engages with the means for engagement and, following isostatic compression, the plugging rod is calcined together with the retaining rod for non-detachable engagement.

19. Process in accordance with claim 18, the retaining rod including a part which projects into the plugging rod, wherein prior to the isostatic compressing, coating the part of the retaining rod that projects into the plugging rod with a material that vaporizes during calcination.

20. An arrangement for connecting an extended plugging rod for a metallurgical vessel to a lifting device for the plugging rod, said arrangement comprising a retaining rod having an upper part and a lower part, said lower part having peripheral ridges and peripheral grooves for non-detachably engaging said plugging rod, said lower part and upper part releasably joined at a segmentation site with a rapid connection device.

21. The arrangement of claim 20, wherein said lower part includes external threads thereon, said rapid connection device includes a coupling having internal threads therein, said upper part and said lower part releasably joined by the mating of said external threads with said internal threads.

22. The arrangement of claim 20, wherein said lower part includes two recesses thereon, said rapid connection device includes a coupling having two holes for communicating with said two recesses and a securing brace having two shanks separated by a space therebetween, said shanks inserted into said holes and engaging in said recesses for connecting said lower part and said upper part.

23. The arrangement of claim 22, wherein said securing brace is U-shaped.

* * * * *